US009681222B2

(12) United States Patent
Park

(10) Patent No.: US 9,681,222 B2
(45) Date of Patent: Jun. 13, 2017

(54) WEARABLE DEVICE USING BONE CONDUCTION SPEAKER

(71) Applicant: CENTER FOR INTEGRATED SMART SENSORS FOUNDATION, Daejeon (KR)

(72) Inventor: JiHoon Park, Daejeon (KR)

(73) Assignee: CENTER FOR INTEGRATED SMART SENSORS FOUNDATION, Daejeon (KR)

( * ) Notice: Subject to any disclaimer, the term of this patent is extended or adjusted under 35 U.S.C. 154(b) by 0 days.

(21) Appl. No.: 14/942,789

(22) Filed: Nov. 16, 2015

(65) Prior Publication Data

US 2016/0142818 A1 May 19, 2016

(30) Foreign Application Priority Data

Nov. 18, 2014 (KR) ..... 10-2014-0160844

(51) Int. Cl.

| | |
|---|---|
| ***H04R 25/00*** | (2006.01) |
| ***H04R 1/46*** | (2006.01) |
| ***G10K 11/16*** | (2006.01) |
| ***H04R 1/14*** | (2006.01) |
| ***H04R 1/10*** | (2006.01) |
| ***H04R 3/02*** | (2006.01) |

(52) U.S. Cl.

CPC ..... *H04R 1/46* (2013.01); *G10K 11/16* (2013.01); *H04R 1/1083* (2013.01); *H04R 1/14* (2013.01);

(Continued)

(58) Field of Classification Search

CPC . H04R 1/14; H04R 1/46; H04R 11/00; H04R 11/06; H04R 25/606;

(Continued)

(56) References Cited

U.S. PATENT DOCUMENTS 5,337,364 A * 8/1994 Fitch ..... A61F 11/04 340/407.1
5,381,387 A * 1/1995 Blonder ..... G04B 47/025 368/10

(Continued)

FOREIGN PATENT DOCUMENTS

EP 0 951 883 A2 10/1999
JP 2000-321995 A 11/2000

(Continued)

OTHER PUBLICATIONS

Office Action for Korean Patent Application No. 10-2014-0160844, dated Oct. 13, 2015.

(Continued)

*Primary Examiner* — Huyen D Le

(74) *Attorney, Agent, or Firm* — Marshall, Gerstein & Borun LLP

(57) ABSTRACT

A wearable device using a bone conduction speaker, including a wearable band worn on an arm of a user, a communication module attached to the wearable band, an audio processor configured to process an audio signal transmitted and received through the communication module, a microphone configured to transmit a voice signal, which is input in sound by the user, to the audio processor, a bone conduction speaker configured to output a reception audio signal, which is processed by the audio processor, in bone conduction mode, and an echo canceller configured to cancel the voice signal in an audio signal output from the bone conduction speaker, is provided.

10 Claims, 5 Drawing Sheets

(52) U.S. Cl.
CPC ..... *H04R 3/02* (2013.01); *H04R 25/606* (2013.01); *H04R 2460/13* (2013.01)

(58) Field of Classification Search
CPC H04R 2460/13; H04R 1/1083; H04R 25/554; H04R 2225/67
USPC ..... 381/318, 326, 151, 380, 385, 386; 379/430, 433.1, 433.06
See application file for complete search history.

(56) References Cited

U.S. PATENT DOCUMENTS 6,912,287 B1 * 6/2005 Fukumoto ..... G06F 1/163 379/430
2014/0056423 A1 2/2014 Nishikawa et al.

FOREIGN PATENT DOCUMENTS

| | | | |
|---|---|---|---|
| JP | 2006-333058 | A | 12/2006 |
| KR | 10-0743062 | B1 | 7/2007 |
| KR | 10-2007-0099940 | | 10/2007 |
| WO | WO-2013/128442 | A1 | 9/2013 |

OTHER PUBLICATIONS

Extended European Search Report for EP 15194426.1, dated Mar. 17, 2016.
Korean-language Office Action for Korean Patent Application No. 10-2014-0160844, dated Apr. 26, 2016.

* cited by examiner

WEARABLE DEVICE USING BONE CONDUCTION SPEAKER

CROSS-REFERENCE TO RELATED APPLICATION(S)

This application claims the benefit under 35 U.S.C. §119(a) of a Korean patent application filed on Nov. 18, 2014 in the Korean Intellectual Property Office and assigned Serial number 10-2014-0160844, the entire disclosure of which is hereby incorporated by reference.

TECHNICAL FIELD

The present disclosure relates to a wearable device using bone conduction and more particularly, to a wearable device providing a call service through bone conduction.

BACKGROUND

General wearable devices may provide call services, for example, through specific wired or wireless headsets which are preliminarily prepared. The usability of wearable devices thus allows users to have hands free. However, a wearable device such as wired/wireless headset needs to be worn on a user for call service. Especially, in the case that a user is violently exercising, a wired/wireless headset could be burdensome to the user and separable from the user. Therefore, instead of an additional wired/wireless headset, it may be preferred to use a bone conduction speaker for a wearable device, which may highly facilitate a user.

SUMMARY

Aspects of the present disclosure are to address at least the above-mentioned problems and/or disadvantages and to provide at least the advantages described below. Accordingly, embodiments of the present disclosure are to provide a wearable device capable of highly facilitating a user through a bone conduction speaker, and a call service providing method using the wearable device.

Especially, in adopting a bone conduction speaker, embodiments of the present disclosure provide a noise-immunized wearable device by employing an echo canceller for cancelling a voice signal, which is input by noise from a user, in an audio signal output from the bone conduction speaker, and a call service providing method using the wearable device.

In accordance with an aspect of the present disclosure, a wearable device using a bone conduction speaker may include a wearable band worn on an arm of a user, a communication module attached to the wearable band, an audio processor configured to process an audio signal transmitted and received through the communication module, a microphone configured to transmit a voice signal, which is input in sound by the user, to the audio processor, a bone conduction speaker configured to output a reception audio signal, which is processed by the audio processor, in bone conduction mode, and an echo canceller configured to cancel the voice signal in an audio signal output from the bone conduction speaker.

The echo canceller may cancel the voice signal in the audio signal, which is output from the bone conduction speaker, through an acoustic transfer function (ATF) estimated corresponding to the voice signal.

The bone conduction speaker may be exposed on an inner surface of the wearable band in contact with a body of the user.

The microphone may be exposed on an outer surface of the wearable band to make the voice signal easily input in sound by the user.

The microphone may be exposed on the outer surface of an area of the wearable band around the mouth of the user if the user is posing to hear an audio signal output from the bone conduction speaker.

The communication module may support wireless communication in connection with a base station accepting a communication network.

The communication module may support local wireless communication in connection with a wireless terminal of the user which is communicable with a base station accepting a communication network.

In accordance with another aspect of the present disclosure, a call service providing method of a wearable device using a bone conduction speaker may include the steps of processing a reception audio signal in an audio processor that processes the audio signal transmitted and received through a communication module attached to a wearable band worn on an arm of a user, transmitting a voice signal, which is input in sound by the user, to the audio processor through a microphone, and outputting the reception audio signal, which is processed by the audio processor, from a bone conduction speaker in bone conduction mode. The step of outputting the reception audio signal in the bone conduction mode may include a step of cancelling the voice signal in an audio signal, which is output from the bone conduction speaker, through an echo canceller.

The step of cancelling the voice signal may include a step of cancelling the voice signal in an audio signal, which is output from the bone conduction speaker, through an acoustic transfer function estimated corresponding to the voice signal.

The step of outputting the reception audio signal in the bone conduction mode may include a step of outputting the reception audio signal in the bone conduction mode form the bone conduction speaker that is exposed on an inner surface of the wearable band in contact with a body of the user.

According to embodiments of the present disclosure, it may be accomplishable to propose a wearable device capable of highly facilitating a user by employing a bone conduction speaker, and a call service providing method using the wearable device.

Especially, in adopting a bone conduction speaker, embodiments of the present disclosure mat propose a noise-immunized wearable device with an echo canceller for cancelling a voice signal, which is input in sound by a user, in an audio signal output from the bone conduction speaker, and a call service providing method using the wearable device.

Other aspects, advantages, and salient features of the disclosure will become apparent to those skilled in the art from the following detailed description, which, taken in conjunction with the annexed drawings, discloses various embodiments of the present disclosure.

DETAILED DESCRIPTION

Figure 1:
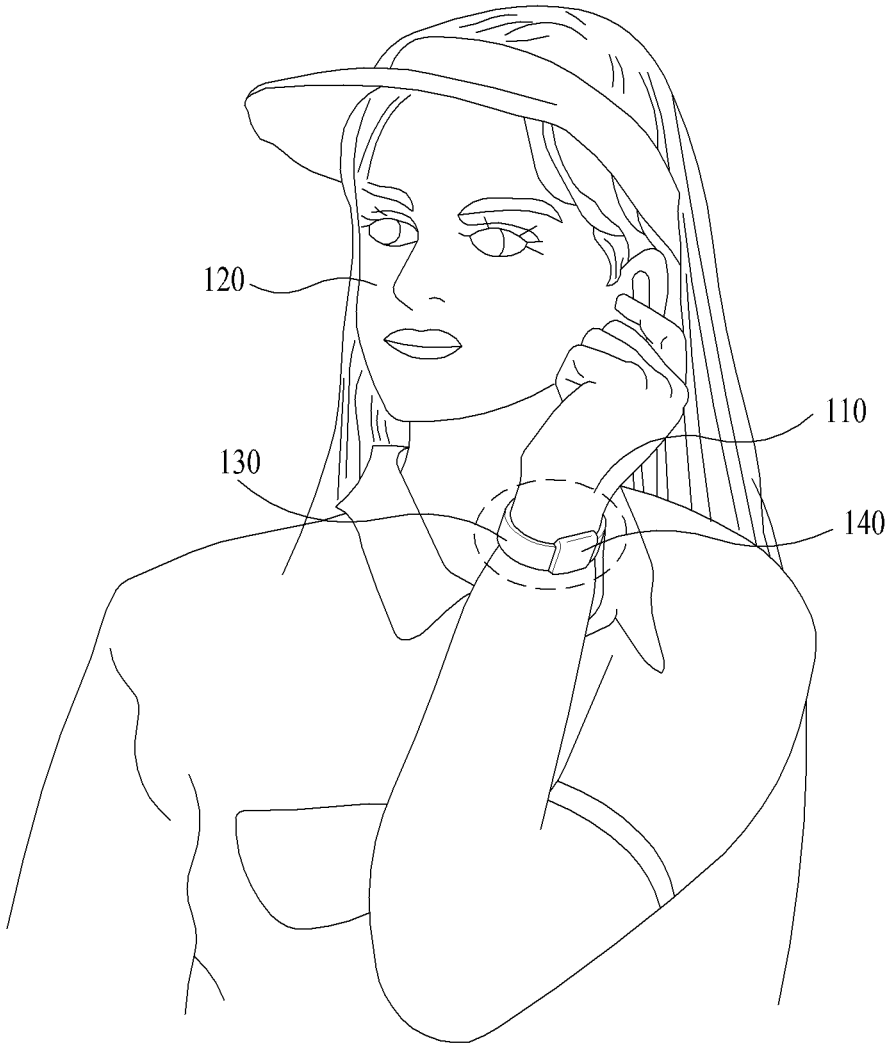
FIG. 1 is a diagram illustrating a wearable device according to an embodiment of the present disclosure.

Hereinafter, various embodiments of the present disclosure will be described in conjunction with the accompanying drawings. Various embodiments described herein, however, may not be intentionally confined in specific embodiments, but should be construed as including diverse modifications, equivalents, and/or alternatives. With respect to the descriptions of the drawings, like reference numerals refer to like elements.

FIG. 1 is a diagram illustrating a wearable device according to an embodiment of the present disclosure.

Referring to FIG. 1, a wearable device 110 according to an embodiment of the present disclosure may include a wearable band 130 worn on an arm of a user 120, a communication module, an audio processor, a microphone, a bone conduction speaker, and an echo canceller. The communication module, the audio processor, the microphone, the bone conduction speaker, and the echo canceller may be embedded in a single body 140 which is attached to a wearable band 130. Otherwise, the communication module, the audio processor, the microphone, the bone conduction speaker, and the echo canceller may be even independently attached to the wearable band 130.

While the wearable device 110 is described as a device providing a call service for a user, it may be used as a watch device providing a call service by further including a display part which further indicates time information. Additionally, the wearable device 110 may be an armband-type wearable device including a wearable band which can be worn on a forearm of the user 120, as well as being a bracelet-type wearable device worn on a wrist of the user 120.

The wearable device 110 may provide a call service to the user 120, instead of an additional wired/wireless headset, by employing a microphone transmitting a voice signal which is input in sound by the user 120, to the audio processor, and a bone conduction speaker outputting a reception audio signal (an audio signal received through the communication module), which is processed by the audio processor, in bone conduction mode.

In this configuration, the bone conduction speaker may be disposed on the inner surface of the wearable band 130 in contact with a body of the user 120. This will be described in detail later with reference to FIG. 2.

Accordingly, as shown in the drawing, the wearable device 110 may provide an easy call service by allowing the user 120 to make the bone conduction speaker be in contact with a body of the user 120. For example, the wearable device 110 may provide a call service to the user 120 while the user 120 is inserting a forefinger of a hand, on which the wearable device 110 is worn, into an ear.

During this, the microphone may be exposed on the outer surface of the wearable band 130 to make a voice signal easily input in sound from the user 120. For example, the microphone may be exposed on the outer surface of an area of the wearable band 130, which is placed around the mouth of the user 120, when the user 120 is posing to hear an audio signal output from the bone conduction speaker.

The wearable device 110 may cancel a voice signal, which is input in sound by the user 120, in an audio signal output from the bone conduction speaker, by employing the echo canceller while a reception audio signal is being output in bone conduction mode from the bone conduction speaker. Accordingly, the wearable device 110 according to an embodiment of the present disclosure may highly facilitate the user 120 and may provide a noise-immunized call service. This will be described in detail later with reference to FIG. 3.

Figure 2:
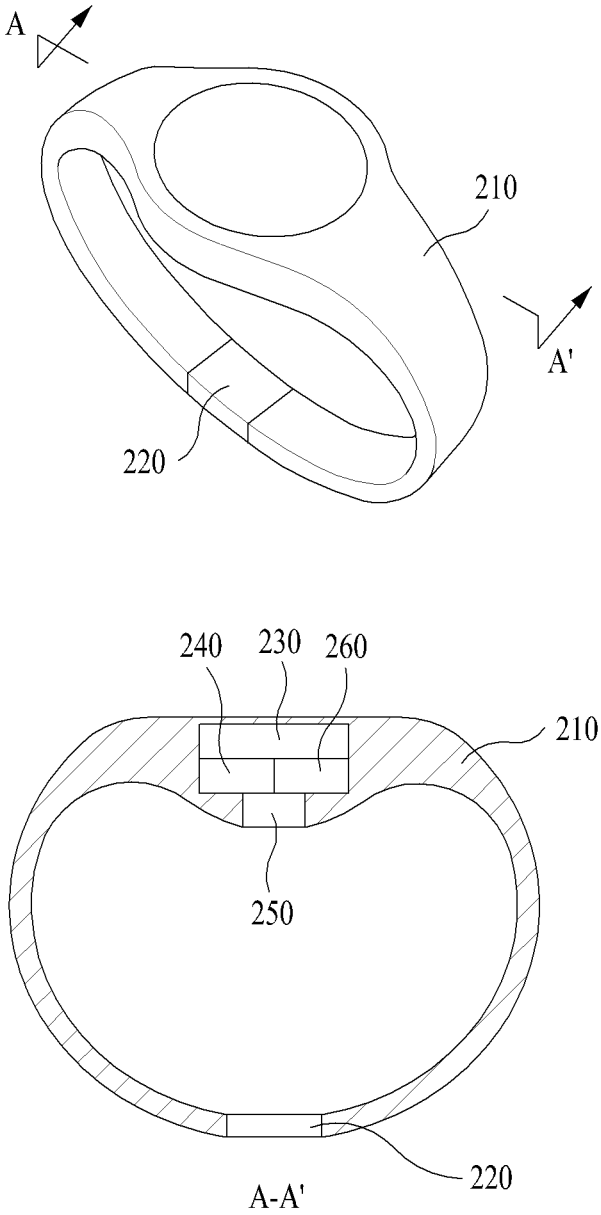
FIG. 2 is a diagram illustrating in detail a perspective view and a cross-sectional view, taken at line A-A of the perspective view, of the wearable device of FIG. 1.

FIG. 2 is a diagram illustrating in detail a wearable device of FIG. 1.

Referring to FIG. 2, a wearable device according to an embodiment of the present disclosure may include a wearable band worn on an arm of a user, a microphone 220 attached to the wearable band 210, a communication module 230, an audio processor 240, a bone conduction speaker 250, and an echo canceller 260.

The communication module 230 may be connected with a base station to support wireless communication. In this case, the wearable device 230 including the communication module 230 may operate as a call terminal. Additionally, the communication module 230 may be connected with a wireless terminal, which is communicable with a base station accepting a communication network, to support local wireless communication (e.g., Bluetooth, RFID, UWB, or Zigbee). In this case, the wearable device including the communication module 230 may be connected with a wireless terminal of a user through local wireless communication and may provide a call service to the user through the wireless terminal of the user.

The audio processor 240 may process an audio signal which is transmitted and received through the communication module 230. This will be described in detail below.

The microphone 220 may be exposed on the outer surface of the wearable band 210 to make a voice signal easily input in sound by a user, and thereby may transmit the voice signal, which is input in sound by the user, to the audio processor 240. During this, when a user is posing to hear an audio signal output from the bone conduction speaker 250, the microphone 220 may be disposed on the outer surface of an area around the mouth of the user. Although not shown in the drawing, the microphone 220 may be electrically connected with the audio processor 240.

The bone conduction speaker 250 may output a reception audio signal, which is processed by the audio processor 240, in bone conduction mode. During this, the bone conduction speaker 250 may be exposed on the inner surface of the wearable band 210 in contact with a body of a user. Accordingly, the bone conduction speaker 250 may be directly in contact with a bone in a body of a user and may output a reception audio signal to the user by way of bone conduction technology.

The wearable device with such a configuration may transmit a voice signal of a user to a base station or a wireless terminal of a user, during a call service, by transmitting an audio signal, which is input in sound by a user, to the audio processor 240 through the microphone 220, processing a transmission audio signal, which is generated from the voice signal, by the audio processor 240, and transmitting the transmission audio signal to a base station or a wireless terminal of a user through the communication module 230.

Additionally, the wearable device may output a reception audio signal, which is transmitted from a base station or a wireless terminal of a user, to a user, during a call service, by receiving the reception audio signal from a base station or a user through the communication module 230, processing the reception audio signal by the audio processor 240, and outputting the reception audio signal to a user through the bon conduction speaker 250.

The echo canceller 260 may cancel a voice signal, which is input in sound by a user, in an audio signal output from the bone conduction speaker 250. For example, the echo canceller 260 may improve the quality of an audio signal, which is output from the bone conduction speaker 250, by removing a voice signal, which is input by a user, from the audio signal output from the bone conduction speaker 250 during a call service for which the voice signal input in sound by the user through the microphone 220 is transmitted to the audio processor and a reception audio signal processed by the audio processor through the bone conduction speaker 250 is output in bone conduction mode.

During this, the echo canceller 260 may cancel a voice signal, which is input by a user, in an audio signal, which is output from the bone conduction speaker 250, through an acoustic transfer function estimated corresponding to the voice signal input by the user. This will be described below.

Figure 3:
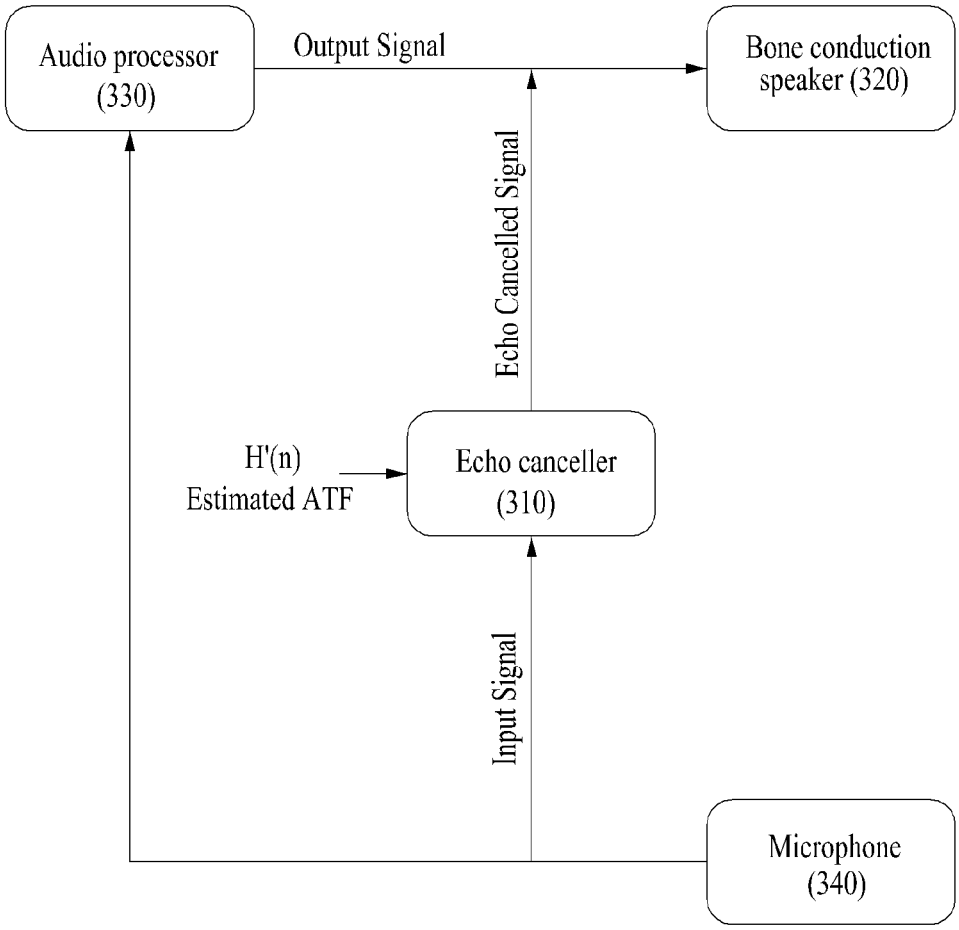
FIG. 3 is a block diagram illustrating an operation of an echo canceller included in a wearable device according to an embodiment of the present disclosure.

FIG. 3 is a block diagram illustrating an operation of an echo canceller included in a wearable device according to an embodiment of the present disclosure.

Referring to FIG. 3, an echo canceller 310 according to an embodiment of the present disclosure may cancel a voice signal, which is input in sound by a user, in an audio signal output from a bone conduction speaker 320.

In detail, the echo canceller 310 may remove noise from an audio signal, which is output from the bone conduction speaker 320, by cancelling a voice signal, which is input in sound by a user through a microphone 340, while a reception audio signal transmitted through a communication module (not shown) is processed by an audio processor 330 and then transmitted to the bone conduction speaker for the user.

During this, the echo canceller 310 may estimate an acoustic transfer function (ATF) corresponding to the voice signal which is input in sound by the user through the microphone 340, and may cancel the voice signal, which is input by the user, in an audio signal, which is output from the bone conduction speaker 320, based on the estimated ATF. In the course of estimating an acoustic transfer function and cancelling a voice signal, which is input by a user, in an audio signal, which is output from the bone conduction speaker 320, based on the estimated ATF, a general echo cancelling technique may be used.

In this manner, a wearable device according to an embodiment of the present disclosure may provide a noise-immunized call service by employing the echo canceller 310 to remove a voice signal, which is input by a user through the microphone 340, while a reception audio signal is being output from the bone conduction speaker 320.

Figure 4:
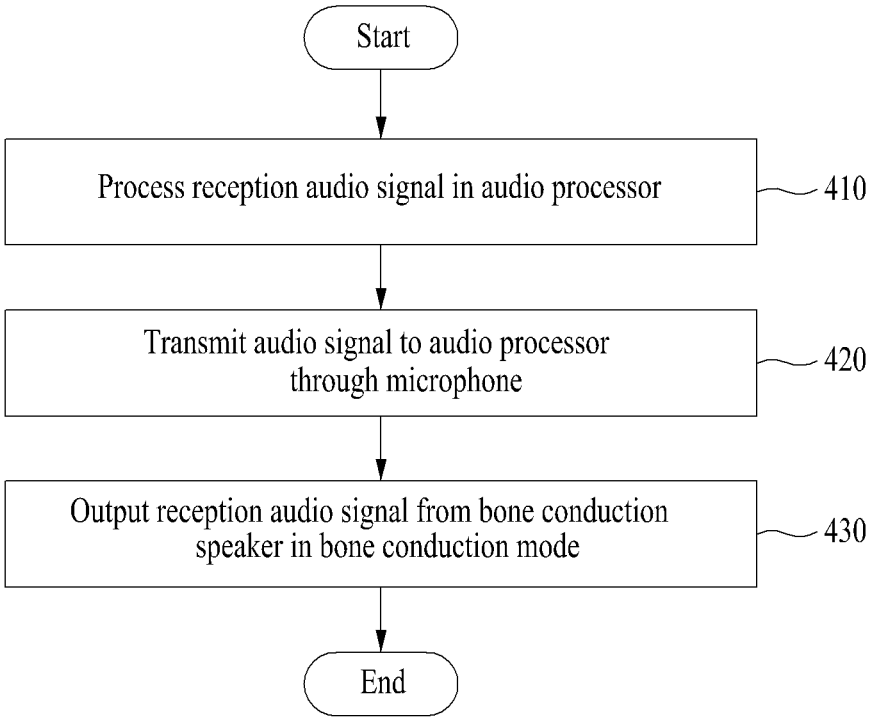
FIG. 4 is a flow chart showing a call service providing method of a wearable device according to an embodiment of the present disclosure.

FIG. 4 is a flow chart showing a call service providing method of a wearable device according to an embodiment of the present disclosure.

Referring to FIG. 4, a wearable device according to an embodiment of the present disclosure may process a reception audio signal in an audio processor which processes an audio signal transmitted and received through a communication module attached to a wearable band which is worn on an arm of a user (step 410). During this, the communication module may support wireless communication I connection with a base station accepting a communication network, or may support local wireless communication in connection with a wireless terminal of a user who is communicable with a base station accepting a communication network.

Additionally, the wearable device may transmit a voice signal, which is input in sound by a user, to the audio processor through a microphone (step 420). During this, the wearable device may transmit the voice signal, which is input in sound by the user, to the audio processor through the microphone which is exposed on the outer surface of the wearable band to make the voice signal easily input in sound by the user. For example, the microphone may be exposed on the outer surface of an area of the wearable band around the mouth of a user when the user is posing to hear an audio signal output from the bone conduction speaker.

Additionally, the wearable device may output the reception audio signal, which is processed by the audio processor, from the bone conduction speaker in bone conduction mode (step 430). During this, the wearable device may output the reception audio signal in bone conduction mode from a bone conduction speaker which is exposed on the inner surface of the wearable band in contact with a body of a user.

In outputting a reception audio signal in bone conduction mode, the wearable device may use an echo canceller to cancel a voice signal in the audio signal which is output from the bone conduction speaker. In detail, the wearable device may cancel a voice signal in an audio signal, which is output from the bone conduction speaker, through the echo canceller using an acoustic transfer function which is estimated corresponding to the voice signal.

Additionally, although not shown, the wearable device may transmit a voice signal, which is processed by the audio processor, as a transmission audio signal to a base station or a terminal of a user through the communication module.

Figure 5:
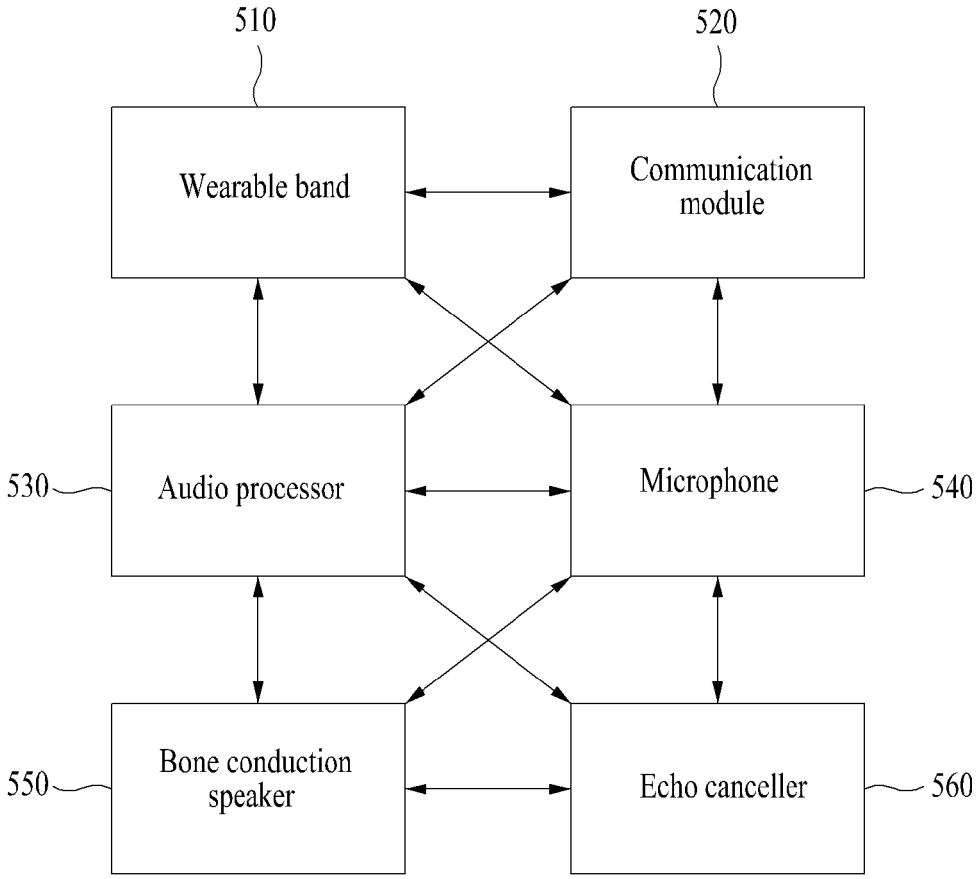
FIG. 5 is a clock diagram illustrating a wearable device according to an embodiment of the present disclosure.

FIG. 5 is a clock diagram illustrating a wearable device according to an embodiment of the present disclosure.

Referring to FIG. 5, a wearable device according to an embodiment of the present disclosure may include a wearable band 510, a communication module 520, an audio processor 530, a microphone 540, a bone conduction speaker 550, and an echo canceller 560.

The wearable band 510 worn on an arm of a user may be attached with the communication module 520, the audio processor 530, the microphone 540, the bone conduction speaker 550, and the echo canceller 560.

The communication module 520 attached to the wearable band 510 may support wireless communication in connection with a base station accepting a communication network or may support local wireless communication in connection with a wireless terminal of a user who is communicable with a base station accepting a communication network. Accordingly, the wearable device may provide a call service to a user in connection with a base station or a terminal of the user through the communication module 520.

The audio processor 530 may process an audio signal which is transmitted and received through the communication module 520.

The microphone 540 may transmit a voice signal, which is input in sound by a user, to the audio processor 530. To this end, the microphone 540 may be exposed on the outer surface of the wearable band 510 to make the voice signal easily input by the user. For example, the microphone 540 may be disposed on the outer surface of an area of the wearable band 510 around the mouth of a user when the user is posing to hear an audio signal output from the bone conduction speaker 550.

The bone conduction speaker 550 may output a reception audio signal, which is processed by the audio processor 530, in bone conduction mode. During this, the bone conduction speaker 550 may be exposed on the inner surface of the wearable band 510 in contact with a body of a user.

Accordingly, the wearable device may highly facilitate a user, by employing the bone conduction speaker 550, in providing a call service to the user.

The echo canceller 560 may cancel a voice signal in an audio signal which is output from the bone conduction speaker 550. During this, the echo canceller 560 may cancel a voice signal in an audio signal, which is output from the bone conduction speaker 550, through an acoustic transfer function estimated corresponding to the voice signal input by a user. Accordingly, the wearable device may provide a noise-immunized call service by employing the echo canceller 560.

While embodiments of the present disclosure have been shown and described with reference to the accompanying drawings thereof, it will be understood by those skilled in the art that various changes and modifications in form and details may be made therein without departing from the spirit and scope of the present disclosure as defined by the appended claims and their equivalents. For example, it may be allowable to achieve desired results although the embodiments of the present disclosure are performed in other sequences different from the descriptions, and/or the elements, such as system, structure, device, circuit, and so on, are combined or assembled in other ways different from the descriptions, replaced or substituted with other elements or their equivalents.

Therefore, other implementations, other embodiments, and equivalents of the appended claims may be included in the scope of the appended claims.

The invention claimed is:

1. A wearable device using a bone conduction speaker, the wearable device comprising:

a wearable band worn on an arm of a user;

a communication module attached to the wearable band;

an audio processor configured to process an audio signal transmitted and received through the communication module;

a microphone configured to transmit a voice signal, which is input acoustically by the user, to the audio processor;

a bone conduction speaker configured to output an audio signal, which is processed by the audio processor, in a bone conduction mode; and an echo canceller connected to the bone conduction speaker and configured to cancel the voice signal in the audio signal to be output from the bone conduction speaker, wherein the echo canceller is further configured to estimate an acoustic transfer function (ATF) using the voice signal that is input acoustically by the user through the microphone, and to cancel the voice signal in the audio signal using the ATF.

2. The wearable device of claim 1, wherein the bone conduction speaker is exposed on an inner surface of the wearable band in contact with a body of the user.

3. The wearable device of claim 1, wherein the microphone is exposed on an outer surface of the wearable band.

4. The wearable device of claim 3, wherein the microphone is exposed on the outer surface of the wearable band and positioned around the mouth of the user when the user is posing to hear the audio signal output from the bone conduction speaker.

5. The wearable device of claim 1, wherein the communication module is configured to support wireless communication in connection with a base station coupled to a communication network.

6. The wearable device of claim 1, wherein the communication module is configured to support local wireless communication in connection with a wireless terminal of the user which is communicable with a base station coupled to a communication network.

7. The wearable device of claim 1, wherein the echo canceller is further configured to estimate the ATF and to cancel the voice signal in the audio signal using the ATF while the voice signal is being input acoustically by the user through the microphone.

8. A call service providing method of a wearable device using a bone conduction speaker, the call service providing method comprising:

processing, via an audio processor, an audio signal that is received through a communication module attached to a wearable band worn on an arm of a user;

transmitting a voice signal, via a microphone, which is input acoustically by the user, to the audio processor or the bone conduction speaker; and outputting the audio signal, which is processed by the audio processor, from the bone conduction speaker in a bone conduction mode, wherein the outputting of the audio signal in the bone conduction mode comprises:

estimating an acoustic transfer function (ATF) using the voice signal that is input acoustically by the user through the microphone, and cancelling the voice signal in the audio signal, which is output from the bone conduction speaker, using the ATF.

9. The call service providing method of claim 8, wherein the outputting of the audio signal in the bone conduction mode comprises:

outputting the audio signal in the bone conduction mode from the bone conduction speaker that is exposed on an inner surface of the wearable band in contact with a body of the user.

10. The call service providing method of claim 8, wherein the outputting of the audio signal in the bone conduction mode further comprises:

estimating the ATF and cancelling the voice signal in the audio signal using the ATF while the voice signal is being input acoustically by the user through the microphone.

* * * * *